US007541906B2

(12) United States Patent
Asaka et al.

(10) Patent No.: US 7,541,906 B2
(45) Date of Patent: Jun. 2, 2009

(54) SINTERED PLUNGER AND PRODUCTION METHOD THEREFOR

(75) Inventors: Kazuo Asaka, Matsudo (JP); Tsuyoshi Akao, Kariya (JP); Aya Hamano, Saitama (JP)

(73) Assignees: Hitachi Powdered Metals Co., Ltd., Matsudo-shi (JP); Denso Corporation, Kariya-shi (JP)

( * ) Notice: Subject to any disclaimer, the term of this patent is extended or adjusted under 35 U.S.C. 154(b) by 503 days.

(21) Appl. No.: 10/571,792

(22) PCT Filed: Sep. 15, 2004

(86) PCT No.: PCT/JP2004/013445

§ 371 (c)(1),
(2), (4) Date: Mar. 15, 2006

(87) PCT Pub. No.: WO2005/029515

PCT Pub. Date: Mar. 31, 2005

(65) Prior Publication Data

US 2007/0085644 A1 Apr. 19, 2007

(30) Foreign Application Priority Data

Sep. 17, 2003 (JP) ..... 2003-325027

(51) Int. Cl.
*H01F 3/00* (2006.01)
*B22F 7/02* (2006.01)
*B22F 7/04* (2006.01)

(52) U.S. Cl. ..... 335/279; 419/8

(58) Field of Classification Search ..... 335/279; 419/8

See application file for complete search history.

(56) References Cited

U.S. PATENT DOCUMENTS 4,503,009 A * 3/1985 Asaka ..... 419/6
6,120,727 A * 9/2000 Asaka et al. ..... 419/6

FOREIGN PATENT DOCUMENTS

EP 0 922 520 A1 6/1999
JP A 2000-087114 3/2000
JP A 2000-087117 3/2000

* cited by examiner

*Primary Examiner*—Ramon M Barrera
(74) *Attorney, Agent, or Firm*—Oliff & Berridge, PLC

(57) ABSTRACT

A sintered plunger is used for electromagnetic actuators. The sintered member includes: an outer member composed of a soft magnetic material and having an inner hole formed therein, and a shaft having an end portion which is fitted into the outer member. The shaft is composed of a ferromagnetic steel, the outer member peripheral is composed of a sintered member, and the shaft and the outer member are integrally bonded by sintering. As a result, the overall sintered plunger can have good magnetic properties, a good magnetic attraction, a good wear resistance, and a good fatigue strength. Electromagnetic actuators having high responsiveness required in recent years can be produced.

9 Claims, 2 Drawing Sheets

SINTERED PLUNGER AND PRODUCTION METHOD THEREFOR

TECHNICAL FIELD

The present invention relates to a plunger which reciprocates by operating electromagnetic attraction and which is used for electromagnetic actuators. In particular, the present invention relates to a sintered plunger having high responsiveness by improving magnetic attraction of the overall structure thereof and ensuring wear resistance and strength thereof. The present invention relates to a production method for producing the above sintered plunger.

BACKGROUND ART

The present invention is an invention for electromagnetic actuators. A solenoid valve will be described as one example of an electromagnetic actuator. A solenoid valve is equipped with a plunger and a stator core which is disposed to face the plunger, wherein the plunger has a valve element which is proximate to a valve seat, and the stator core has a solenoid coil which is wound therearound. In the solenoid valve constructed in the above manner, an electric current is supplied to the solenoid coil so that the plunger is attracted in a longitudinal direction thereof by magnetic force which is generated between the stator core and the plunger. As a result, switching operation of the solenoid valve is performed. The plunger is required to have high magnetic flux density as a component of the solenoid valve. When a shaft of the solenoid valve reciprocates in an axial direction, the shaft of the solenoid valve slides on a pivot for stabilizing an orbit thereof in the axial direction. When the shaft moves to a side opposite to the stator core of the shaft, the shaft repeatedly collides with another member (for example, a valve seat of a solenoid valve having a plunger and a valve element which are integrally combined with each other). Therefore, the shaft is required to have good wear resistance and good fatigue strength against the repeated impacts. Due to these, in recent years, a plunger having a shaft and an outer member which are separate from each other is produced, wherein the shaft has good mechanical properties and the outer member is composed of a soft magnetic material having strong magnetic properties.

FIGS. 1A and 1B are side views showing a typical structure of a solenoid valve equipped with a plunger having separate members as described above. As shown in the Figures, a solenoid valve is equipped with a plunger 3 and a stator core 4. The plunger 3 has a shaft 1 having a valve element 1*a* proximate to a valve seat (not shown in the Figures) at one end side of the plunger 3, and has a typically cylindrical outer member 2 at the other end of the plunger 3. The stator core 3 is disposed to face the plunger 3 in a radial direction (FIG. 1A) of the shaft 1 or a longitudinal direction of the shaft 1 (FIG. 1B). A solenoid coil 5 is wound around the stator core 4. In the solenoid valve shown in FIG. 1A, an electric current is supplied to the solenoid coil 5 wound around the stator core 4, so that the plunger 3 is attracted in a longitudinal direction thereof by a magnetic force which is generated between the stator core 4 and the plunger 3. And the direction of the electric current is changed, so that the plunger 3 returns to the initial state by the change of direction of the electric current supplied to the solenoid coil 5 or by a restoring force of a spring (not shown in the Figures). As a result, the plunger 3 moves forward or backward. In the solenoid valve shown in FIG. 1B, an electronic current is supplied to the solenoid coil 5 wound around the stator core 4, so that the plunger 3 is attracted toward the stator core 4 by magnetic force, and the solenoid valve is thereby opened. Supply of the electromagnetic current to the solenoid coil 5 is stopped, so that the plunger 3 returns to the initial state by a restoring force of a spring (not shown in the Figures).

This switching operation of the solenoid valve depends on a magnetic field generated between the plunger 3 and the stator core 4 based on the change of the electric current supplied to the solenoid coil 5. FIGS. 1A and 1B show directions of lines of magnetic force by dotted lines, which are lines of magnetic force generated when an electric current is supplied to the solenoid coil 5. In order to increase a magnetic flux density generated in the above manner and use magnetic fields effectively, in conventional techniques, it was preferable that a nonmagnetic steel be used for the shaft 1 of the plunger 3, so that leakage of magnetic flux be inhibited. For example, a nonmagnetic stainless steel SUS304 of the Japanese Industrial Standards (=JIS) was generally used for the shaft 1. The steel SUS304 corresponds to a steel 304 of the American Iron and Steel Institute(=AISI).

In the above manner, in the case in which a nonmagnetic stainless steel is used for the shaft 1, in the conventional solenoid valve shown in FIG. 1A, the shaft 1 which is nonmagnetic and the outer member 2 are typically composed of a steel, and are bonded integrally with each other by press-fitting and caulking. However, there are various limitations to the plunger 3, for example, limitations to the material of the plunger, shape thereof, and production process therefor. For example, only materials which can be plastically deformed are used for the plunger 3. Extremely precise dimensions are required for the finishing of the inner diameter of the plunger 3, so that production costs are increased. In a case in which a material of the plunger 3 is subjected to plastic working, the material must occupy a space of a predetermined size for plastic working, so that there are limitations in the reduction in size and weight of the plunger 3.

In order to overcome the above limitations, a sintered plunger is proposed for a solenoid valve having a structure shown in FIG. 1A (see Patent Publication 1). In Patent Publication 1, the outer member 2 is composed of a sintered material, and the shaft 1 made of a nonmagnetic steel is fit into an inner hole of a green compact of the outer member 2. Next, the outer member 2 and the shaft 1 are bonded with each other by sintering, wherein sintering of the outer member 2 and diffusion bonding of the outer member 2 and the shaft 1 are performed in one processing. A technique is proposed in which a member has a shaft portion made of a steel, a green compact having a hole portion is made by compacting a powder of an Fe-based alloy or a mixed powder of an Fe-based alloy, the member and the green compact are sintered in the condition in which the shaft portion is fit into the hole portion (see Patent Publication 2).

Patent Publication 1 is Japanese Unexamined Patent Application Publication No. 2000-87117. Patent Publication 2 is Japanese Unexamined Patent Application Publication No. 2000-87114.

DISCLOSURE OF THE INVENTION

Problems Solved by the Invention

However, in recent years, in particular, in electromagnetic actuators, for example, solenoid valves used for fuel injection apparatuses of automobiles, much higher responsiveness is required. In order to increase response speed of electromagnetic actuators, a method using a spring stronger than a conventional one has been considered for increasing the speed of a valve element of a plunger returning to a valve seat. However, in order to realize this method, a plunger of electromagnetic actuators, for example, solenoid valves are required to magnetic properties. Thus, the plunger can resist the force of a spring so as to be attracted to a side of a stator core. In order to resist repeated impacts of a valve element with respect to a valve seat at high speed, a plunger is required to have high wear resistance and high fatigue strength.

The present invention was made in consideration of the above problems. An object of the present invention is to provide a plunger which has good magnetic properties so as to be sufficiently attracted to a side of a stator core even in a case in which a strong spring is used. An object of the present invention is to provide a plunger which has a high wear resistance and a high fatigue strength. Due to these, electromagnetic actuators such as electromagnetic valves having high responsiveness required in recent years are obtained. An object of the present invention is to provide a production method for the above plungers.

Means for Solving the Problems

The inventors performed intensive research on a solenoid valve equipped with a plunger having the above good magnetic properties, and a high wear resistance and a high fatigue strength such that the plunger is resistant to repeated impacts given by a valve seat. The inventors obtained the following findings. That is, a shaft 1 is composed of a ferromagnetic steel instead of a nonmagnetic steel which was conventionally preferably used for the shaft 1. In this feature, even if a strong spring is used for a solenoid valve, a plunger 3 is obtained to have good magnetic properties so as to be sufficiently magnetically attracted toward the stator core 4. And a solenoid valve can be produced to have a high level of responsiveness required in recent years. FIGS. 2A and 2B show lines of magnetic force generated in the above feature. It is confirmed that a solenoid valve shown in FIGS. 2A and 2B allow more magnetic flux to pass therethrough. The present invention was made based on the above findings.

That is, according to one aspect of the present invention, a sintered plunger used for electromagnetic actuators includes: an outer member composed of a soft magnetic material and having an inner hole formed therein; and a shaft having an end portion which is fitted into the outer member. The shaft is composed of a ferromagnetic steel, the outer member is composed of a sintered member, and the shaft and the outer member are integrally bonded by sintering them. In a preferred embodiment of the present invention, the ferromagnetic steel has a magnetic flux density of 0.3 T or more in a magnetic field of 10 KA/m, and has a hardness of Hv 600 or more. The steel may be selected from the group consisting of a tool steel, a bearing steel, and a martensitic stainless steel. In this case, it is preferable that the steel be the tool steel, and it is the most preferable that the tool steel be a high speed steel. A steel SKH51 of the JIS is preferably used for the high speed steel. The steel SKH51 corresponds to a steel M2 of the Society of Automotive Engineer (=SAE), a steel HS6-5-2 of the International Organization for Standardization (=ISO), and a steel W6Mo5Cr4V2 of the Guo jia Biao zhun (=GB).

In a preferred embodiment, the sintered plunger includes: a diffusion bonding layer which is formed between the shaft and the outer member; and a ferrite phase formed in the diffusion layer proximate to the shaft, and having a width of 500 μm or less. The width of the diffusion bonding layer 6 proximate to the shaft 1 is a length from an outer peripheral surface of the previous diffusion-bonding shaft 1 along a radial direction of the shaft 1. In FIGS. 2A and 2B, reference numeral 6 denotes the diffusion bonding layer, and the diffusion bonding layer 6 corresponds to a boundary portion between the shaft 1 and the outer member 3.

In a preferred embodiment, the soft magnetic material is selected from a group consisting of a ferrite, an Fe—P-based alloy, an Fe—Si-based alloy, an Fe—Si—P-based alloy, a permalloy, a permemdur, and an electromagnetic stainless material. In this case, it is preferable that the soft magnetic material have a porosity of 15% or less.

According to another aspect of the present invention, a production method is a method for producing a sintered plunger used for electromagnetic actuators. As described above, the sintered plunger includes: an outer member composed of a soft magnetic material and having an inner hole formed therein; and a shaft having an end portion fitted in the outer member. The production method includes: preparing a raw powder having a soft magnetic property; compacting the raw powder into a green compact having an inner hole; and fitting the shaft into the inner hole of the green compact, the shaft composed of a ferromagnetic steel. The production method further includes: integrally diffusion bonding the shaft and the green compact during sintering at a temperature of from 1000 degrees C. to 1300 degrees C., in a nonoxidizing atmosphere which is other than a carburizing atmosphere. The production method further includes: quenching and tempering the shaft and the compact integrally bonded, so that the sintered plunger is obtained. In a preferred embodiment, the temperature is from 1100 degrees C. to 1200 degrees C. In a preferred embodiment, fitting of the green compact and the shaft is clearance-fit having a clearance therebetween of 50 μm or less which is a fit size difference. Alternatively, fitting of the green compact and the shaft is interference fitting having an interference of 20 μm or less.

Effects of the Invention

According to one aspect of the present invention, in the sintered plunger, the shaft is composed of a ferromagnetic material, and the outer member is composed of a sintered soft magnetic member. The end portion of the shaft is fitted into the outer member, and the shaft and the outer member are integrally bonded by sintering them. As a result, the overall sintered plunger can have good magnetic properties, a good magnetic attraction, a good wear resistance, and a good fatigue strength. Electromagnetic actuators having high responsiveness required in recent years can be produced.

BRIEF DESCRIPTION OF THE DRAWINGS

FIG. 1A shows an example in which a stator core 4 is disposed to face a plunger 3 in a radial direction of a shaft 1, and FIG. 1B is an example in which the stator core 4 is disposed to face the plunger 3 in a longitudinal direction of the shaft 1.

FIGS. 2A and 2B show directions of lines of generated magnetic force; FIG. 2A shows an example in which a stator core 4 is disposed to face a plunger 3 in a radial direction of a shaft 1, and FIG. 2B is an example in which the stator core 4 is disposed to face the plunger 3 in a longitudinal direction of the shaft 1.

EXPLANATION OF REFERENCE NUMERALS

1 indicates a shaft, 1*a* indicates a valve seat, 2 indicates an outer member, 3 indicates a plunger (sintered plunger), 4 indicates a stator core, 5 indicates a solenoid coil, and 6 indicates a diffusion bonding layer

BEST MODE FOR CARRYING OUT THE INVENTION

Figure 1A:
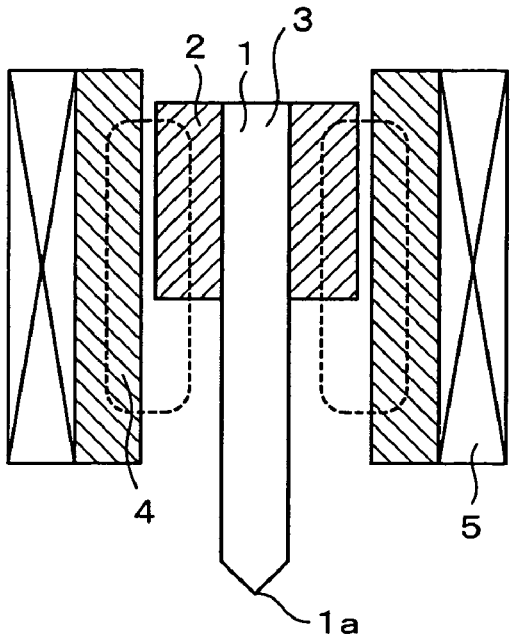
FIGS. 1A and 1B are schematic diagrams which shows an arrangement of a plunger and a stator core in an electromagnetic actuator and shows directions of lines of generated magnetic force.
Figure 1B:
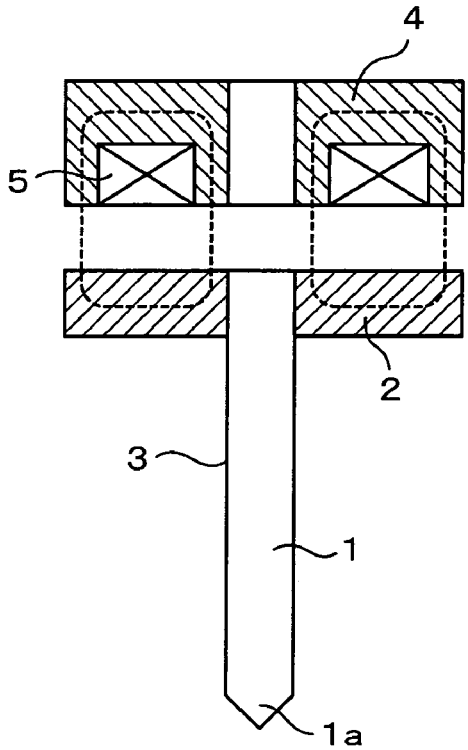
Figure 2A:
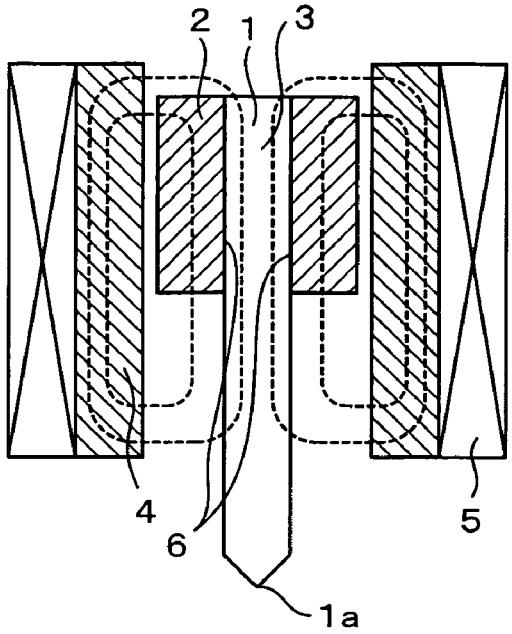
FIGS. 2A and 2B are schematic diagrams which show an arrangement of a plunger and a stator core in an electromagnetic actuator, to which a sintered plunger of the present invention is applied.
Figure 2B:
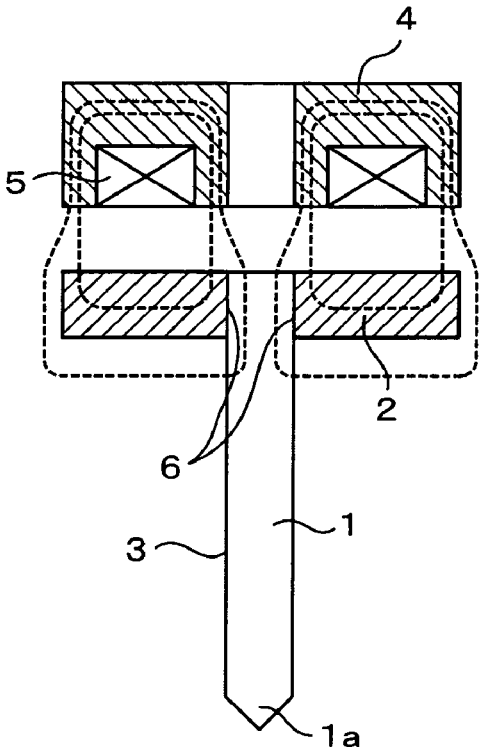

An embodiment will be explained hereinafter. Conventionally, in consideration of lines of magnetic force shown in FIGS. 1A and 1B by dotted lines, in order to increase magnetic flux density and increase magnetic attraction of a plunger overall, it was effective for a shaft to be composed of a non-magnetic steel, so that leakage of magnetic flux is inhibited. However, it was confirmed that a shaft is composed of a ferromagnetic steel, so that lines of magnetic force are generated as shown in FIGS. 2A and 2B, magnetic permeability of a sintered plunger can increase in total, and magnetic attraction thereof can increase even more.

In consideration of impacts of the shaft on a valve seat, the shaft is required to be superior in wear resistance and fatigue strength in view of the repeated impacts to be given thereto. These mechanical properties can be improved by increasing hardness of the shaft. However, after the shaft is fitted into a green compact composed of a soft magnetic material, the shaft is bonded therewith by sintering them in the above condition. Therefore, in the sintering at a high temperature, a large change in a structure of the shaft is generated such that crystal grains thereof are roughly enlarged, and the wear resistance and the strength thereof may be decreased. It should be noted that the shaft may have a hardness required by electromagnetic actuators to which the shaft is applied.

From the above viewpoints, it is preferable that a ferromagnetic steel having a high magnetic flux density and a high hardness be used for the shaft. The higher the magnetic flux density is, the higher the ferromagnetism the steel exerts, so that the magnetic attraction thereof increases. The increase in the magnetic attraction can be realized when the magnetic flux density is 0.3 T or more in a magnetic field of 10 kA/m or more. In this case, it is more preferable that the magnetic flux density be 1.0 T or more, so that the increase in the magnetic attraction can be greatly realized. The hardness of the steel is determined by a property of an electromagnetic actuator. When the hardness is Hv 600 or more, the effects can be obtained by good wear resistance and increase in fatigue strength. High speed steels, bearing steels, and martensitic stainless steels are used for the steel satisfying the above properties, and the high speed steels exhibit the best properties of the above steels. For example, the high speed tool steel is a steel SKH of the JIS.

Conventionally, since a green compact has a low strength, in a case in which a green compact is thin, the green compact may be broken in bonding the green compact and the shaft by sintering them. However, the shaft is composed of a steel selected from a group consisting of the above steels, so that the above problem can be solved. That is, the above steel has a bcc (=body centered cubic) lattice before bonding the shaft and the green compact by sintering them. At about 800 degrees C. in the temperature rise in the bonding by sintering them, a structure of the steel is transformed from a bcc lattice to a fcc (=face centered cubic) lattice. As a result, a contraction thereof occurs, and a temporary gap between the shaft and the green compact is generated. On the other hand, in the green compact, element diffusion occurs at about 800 degrees C., so that neck portions are formed, and the strength of the compact increases, and the strength of the compact becomes large when the compact contacts the shaft by contraction thereof in the sintering. Therefore, the compact is difficult to break in a case in which the green compact is thin.

In the sintering, diffusion bonding among powders of the soft magnetic compact is accelerated, and the soft magnetic compact is densified, so that the strength and the magnetic property of the soft magnetic compact thereby increase. In the sintering, the compact and the shaft are diffusion-bonded. In a case in which the sintering temperature is less than 1000 degrees C., the compact is insufficiently densified, the strength and the magnetic property of the outer member are insufficient, and the diffusion bonding between the compact and the shaft is insufficient. Due to this, the lower limit of the sintering temperature is 1000 degrees C. It is more preferable that the lower limit of the sintering temperature be at least 1100 degrees C. On the other hand, the higher the sintering temperature is, the more the diffusion between the shaft and the soft magnetic material is accelerated, and strong bonding therebetween can be obtained. However, in a case in which the sintering temperature is 1300 degrees C. or more, recovery of the hardness is difficult by a heat treatment even if the shaft is composed of a high speed steel. Therefore, the upper limit of the sintering temperature is 1300 degrees C. in a case in which bonding strength is considered as an important property. On the other hand, in a case in which the sintering temperature is 1200 degrees C. or less, a heat treatment of quenching and tempering is performed after integrally bonding the compact and the shaft during by sintering. Therefore, the hardness of the shaft recovers. Therefore, the shaft is highly wear resistant as required and can be obtained with a high fatigue strength for repeated impacts given thereto. Therefore, it is more preferable that the upper limit of the sintering temperature be 1200 degrees C.

Regarding an atmosphere in the sintering, in a case in which the atmosphere is an oxidizing atmosphere, Fe included in the outer member decreases by oxidizing it, and the magnetic property thereof decreases, so that it is necessary that the atmosphere be a nonoxidizing atmosphere. However, even if the atmosphere is a nonoxidizing atmosphere, in a case in which the atmosphere is a carburizing atmosphere, C included in the carburizing atmosphere is diffused into Fe included in the outer member, so that the magnetic properties thereof decrease, and the outer member has a tendency to expand by the above diffusion of C in the sintering, and the bonding of the outer member and the shaft is insufficient. Therefore, it is necessary that the sintering atmosphere be a nonoxidizing atmosphere other than a carburizing gas atmosphere.

Size difference between the shaft and the outer member (difference in size between an inside diameter of a hole of the green compact and an outside diameter of the shaft) in fitting the shaft into the outer member is important. It is preferable that the size of the outside diameter of the shaft be large (this case is called "interference fit"), and the shaft is fit into the hole of the green compact. The larger the interference is, the higher the degree of contact between the shaft and the outer member is. In a case in which the outer member is composed of a green compact having a lower strength, it is preferable that the interference be 20 μm or less, and is more preferably 10 μm or less in order to prevent damage to the outer member caused by tensile stress. On the other hand, in a case in which clearance fit is used for fitting the shaft into the outer member, the clearance fit is good when the clearance is small. Therefore, it is preferable that 50 μm or less.

EXAMPLES

Example 1

An Fe—P based alloy powder and a Si powder were mixed into an Fe powder at a predetermined ratio. The Fe—P based alloy powder contained 20 mass % of P. As a result, soft magnetic powder containing 0.6 mass % of P, 2.0 mass % of Si, the balance of Fe and inevitable impurities was obtained. The soft magnetic powder was compacted into a soft magnetic green compact at a compression pressure of 700 MPa, wherein the soft magnetic powder green compact had a ring shape having an outer diameter of 18 mm, an inner diameter of 6 mm, and a height of 3 mm.

Steel shafts composed of steels SKH51, SUJ2, and SUS440C (ferromagnetic steels) of the JIS having a diameter of 6 mm, and a height of 15 mm and a steel of SUS304 (nonmagnetic steel) of the JIS having a diameter of 6 mm, and a height of 15 mm were prepared. The steel SKH51 corresponds to a steel M2 of the AISI. The steel SUJ2 corresponds to a steel 52100 of the AISI. The steel SUS440C corresponds to a steel 440C of the AISI. The SUS304 corresponds to a steel 304 of the AISI. The steel shafts were respectively fitted into soft magnetic green compacts, and were sintered at a temperature of 1200 degrees C. in a vacuum, thereby being integrally bonded with the soft magnetic green compact. Next, the steel shafts of the steel SKH51 was subjected to quenching at a temperature of 1160 degrees C., and was subjected to tempering at a temperature of 550 degrees C. The steel shaft of the steel SUJ2 was subjected to quenching at a temperature of 800 degrees C., and was subjected to tempering at a temperature of 170 degrees C. The steel shaft of the steel SUS440C was subjected to quenching at a temperature of 1100 degrees C., and was subjected to tempering at a temperature of 170 degrees C. The steel shaft of the steel SUS304 was not subjected to quenching and tempering since the steel SUS304 is not generally subjected to quenching. In the above manner, sintered plungers A to D shown in Table 1 were obtained.

Regarding each of the above sintered plungers A to D, the flux density of each used steel shaft at a magnetic field of 10 kA/m is shown in Table 1. Table 1 shows the measurement results of the shaft hardness of each obtained sintered plunger. Table 1 shows the measurement results of the magnetic attraction of each obtained sintered plunger combined with a pot coil-type stator core of a steel containing 3 mass % of Si and having a diameter of 18 mm. Table 1 shows the measurement results of the grain diameter of each steel shaft.

TABLE 1

| | Kind of Steel shaft | Magnetic Flux Density $B_{10000}$ (T) | Range of Hardness (Hv) of Steel shaft | Magnetic Force (N) | Grain Diameter (μm) |
|---|---|---|---|---|---|
| Sintered plunger A | Steel SKH51 | 1.27 | 707 to 732 | 65 | about 20 |
| Sintered plunger B | Steel SUJ2 | 1.29 | 671 to 713 | 66 | about 150 |
| Sintered plunger C | Steel SUS440C | 0.4 | 328 to 707 | 55 | about 100 |
| Sintered plunger D | Steel SUS304 | 0.01 | 150 to 167 | 51 | about 100 |

As shown in Table 1, it was confirmed that the sintered plungers A to C having the steel shafts composed of the ferromagnetic steels SKH51, SUJ2, and SUS440C having a magnetic flux density of 0.3 T exhibited a magnetic attraction stronger than the sintered plunger D having the steel shaft composed of the non-magnetic steel. It was confirmed that the sintered plungers A and B having the steel shafts composed of the ferromagnetic steels having a magnetic flux density of 1.0 T or more exhibited very strong magnetic attraction. Regarding the hardness, the steel shafts of the steels SKH51, SUJ2, and SUS440C had heat-treated hardness higher than the steel shaft of the steel SUS304. In particular, the steel shafts of the steels SKH51 and SUJ2 had even hardness and were greatly wear resistant. In particular, in the steel shaft of the steel SKH51, even if grains thereof are large to some degree in the sintering, the steel shaft of steel SKH51 can be densified by heat treating after the sintering. Therefore, the steel shaft of the steel SKH51 can have a good fatigue strength.

Example 2

The soft magnetic green compacts A of the Example 1 and steel shafts of the steel SKH51 were used, and sintered plungers E to I were obtained in the same manner as in the Example 1 other than that sintering temperatures varied from 900 degrees C. to 1300 degrees C. Table 2 shows the measurement results of the shaft hardness of each obtained-sintered plunger. Table 2 shows the measurement results of the magnetic attraction of each obtained sintered plunger combined with a pot coil-type stator core of a steel containing 3 mass % of Si and having a diameter of 18 mm. The outer portion of the sintered plunger was fixed and the pressure was applied to the shaft portion of the sintered plunger. Then, ejection pressure was measured, which was applied to a shaft portion when the shaft portion fell from a fixed outer portion. Table 2 shows the measurement results of the ejection pressure.

TABLE 2

| | Sintering Temperature (degrees C.) | Range of Hardness (Hv) of Steel shaft | Magnetic Force (N) | Ejection Pressure (MPa) |
|---|---|---|---|---|
| Sintered plunger E | 900 | 707 to 720 | 50 | 50 |
| Sintered plunger F | 1000 | 695 to 732 | 57 | 100 |
| Sintered plunger G | 1100 | 713 to 720 | 61 | 150 |
| Sintered plunger H | 1200 | 707 to 732 | 65 | 240 |
| Sintered plunger I | 1300 | 511 to 707 | 66 | 340 |

As shown in Table 2, it was confirmed that in the sintered plunger E of which the sintered temperature was 900 degrees C., the outer member was insufficiently densified by sintering, so that the magnetic attraction was low. In the sintered plunger E, diffusion bonding of the outer member and the shaft was insufficient, so that the ejection pressure was also low. In contrast, regarding the sintered plungers F to I, it was confirmed that as the sintering temperature rose, the densifying of the outer member was accelerated, so that the magnetic attraction and the ejection pressure increased. The ejection pressure in the case of the sintering temperature of 1300 degrees C. was highest. In the cases of the sintering temperature of 1100 degrees C. or more, the sintered plungers exhibited good magnetic attraction, and high ejection pressure. It was confirmed that in a case in which the sintering temperature exceeded 1200 degrees C., effects by the increase in the magnetic attraction were insufficient. On the other hand, it was confirmed that when the sintering temperature was 1200 degrees C. or less, the hardness of the steel shafts and the range of the hardness thereof were approximately equal to each other. However, when the sintering temperature exceeded 1200 degrees C., the lower limit of the range of the hardness thereof was reduced. The reasons are considered to be as follows. That is, when the sintering temperature was 1200 degrees C. or less, the growth of carbide grains was insufficient. When the sintering temperature exceeded 1200 degrees C., the grains of the steel shaft and carbide grains roughly increased in size such that the growth of the grains occurred rapidly, and the grains could not be fined by treatments after the sintering. As described above, the lower limit of the sintering temperature is preferably at least 1000 degrees C., and is more preferably at least 1100 degrees C. The upper limit of the sintering temperature is 1300 degrees C. in a case in which the bonding strength is considered to be important. The upper limit of the sintering temperature is 1200 degrees C. or less in a case in which the hardness is considered to be important.

Example 3

The soft magnetic green compacts A of the Example 1 and steel shafts of the steel SKH51 were used. And sintered plungers J to S were obtained in the same manner as in the Example 1 other than that the overlap length in press fit thereof was +100 μm (clearance fit) to −50 μm (interference fit). Table 3 shows the measurement results of the ejection pressure applied to a shaft portion when the shaft portion fell from a fixed outer portion.

TABLE 3

| | Interference (μm) | Ejection Pressure (MPa) | Note |
|---|---|---|---|
| Sintered plunger J | +100 (clearance fit) | 20 | Fall out |
| Sintered plunger K | +50 (clearance fit) | 100 | Good |
| Sintered plunger L | +20 (clearance fit) | 160 | Good |
| Sintered plunger M | +10 (clearance fit) | 200 | Good |
| Sintered plunger N | +5 (clearance fit) | 230 | Good |
| Sintered plunger O | ±0 | 240 | Good |
| Sintered plunger P | −5 (interference fit) | 245 | Good |
| Sintered plunger Q | −10 (interference fit) | 250 | Good |
| Sintered plunger R | −20 (interference fit) | 255 | Good |
| Sintered plunger S | −50 (interference fit) | x | Crack generating in Green compact |

As shown in Table 3, it was confirmed that in the sintered plunger J of the clearance of 50 μm or more in the clearance fit, the clearance was too large, so that the ejection pressure was very low. However, in the clearance fit having a clearance of 50 μm or less, the bonding strength was sufficient in practice. The smaller the clearance, the higher the ejection pressure, so that the bonding strength increased. However, it was confirmed that in the interference fit having a clearance of −20 μm or less (interference of 20 μm or more), cracks were generated in the green compact in the fitting of the green compact and the steel shaft. As described above, it was confirmed that in the fitting of the green compact and the steel shaft, the sufficient bonding thereof could be obtained by either the clearance fit having a clearance of 50 μm or less or by the interference fit having an interference of 20 μm or less.

INDUSTRIAL APPLICABILITY

According to one aspect of the present invention, even when a strong spring is applied to the sintered plunger, the responsiveness of the sintered plunger can be high since the magnetic attraction of the plunger increases, and the strength and the wear resistance of the shaft increase. Therefore, the sintered plunger can be applied to, for example, electromagnetic actuators which are used for stroke control apparatuses, and which reciprocate by operation of electromagnetic attraction. The stroke control apparatuses are run by a solenoid for hydraulic pumps, fuel injunction apparatuses of engines for automobiles, and other fluid control apparatuses of which the responsiveness is required to be high in recent years.

The invention claimed is:

1. A sintered plunger used for electromagnetic actuators, comprising:

an outer member composed of a soft magnetic material and having an inner hole formed therein; and a shaft having an end portion which is fitted into the outer member, wherein the shaft is composed of a ferromagnetic steel, the outer member is composed of a sintered member, and the shaft and the outer member are integrally bonded by sintering them.

2. A sintered plunger according to claim 1, wherein the ferromagnetic steel has a magnetic flux density of 0.3 T or more in a magnetic field of 10 KA/m, and has a hardness of Hv 600 or more.

3. A sintered plunger according to claim 2, wherein the ferromagnetic steel is selected from a group consisting of a tool steel, a bearing steel, and a martensitic stainless steel.

4. A sintered plunger according to claim 3, wherein the tool steel is a high speed steel.

5. A sintered plunger according to claim 3, wherein the sintered plunger comprising:

a diffusion bonding layer which is formed between the shaft and the outer member; and a ferrite phase formed in the diffusion layer proximate to the shaft, and having width of 500 μm or less.

6. A sintered plunger according to claim 1, wherein the soft magnetic material is selected from a group consisting of a ferrite, an Fe—P-based alloy, an Fe—Si-based alloy, an Fe—Si—P-based alloy, a permalloy, a permemdur, and an electromagnetic stainless material.

7. A sintered plunger according to claim 6, wherein the soft magnetic material has a porosity of 15% or less.

8. A production method for a sintered plunger used for electromagnetic actuators, the sintered plunger comprising:

an outer member composed of a soft magnetic material and having an inner hole formed therein; and a shaft having an end portion fitted in the outer member, the production method comprising:

preparing a raw powder having a soft magnetic property;

compacting the raw powder into a green compact having an inner hole;

fitting the shaft into the inner hole of the green compact, the shaft composed of a ferromagnetic steel;

integrally diffusion bonding the shaft and the green compact during sintering at a temperature of from 1000 degrees C. to 1300 degrees C., in a nonoxidizing atmosphere which is other than a carburizing atmosphere; and quenching and tempering the shaft and the compact which are integrally bonded, so that the sintered plunger is obtained.

9. A production method for a sintered plunger according to claim 8, wherein fitting of the green compact and the shaft is clearance fit having a clearance therebetween of 50 μm or less which is fit size difference or is interference fit having an interference of 20 μm or less.

* * * * *